US005215676A

United States Patent [19]

Stone

[11] Patent Number: 5,215,676

[45] Date of Patent: Jun. 1, 1993

[54] RUST AND STAIN REMOVAL COMPOSITION

[76] Inventor: John A. Stone, 1407 Seagull Ct., Punta Gorda, Fla. 33950

[21] Appl. No.: 944,419

[22] Filed: Sep. 14, 1992

[51] Int. Cl.[5] ..... C11D 1/62

[52] U.S. Cl. ..... 252/136; 252/106; 252/117; 252/142; 252/528; 252/574; 252/82

[58] Field of Search ..... 252/106, 117, 173, 82, 252/136, 142, 528, 574

[56] References Cited

U.S. PATENT DOCUMENTS

| | | | |
|---|---|---|---|
| 2,672,449 | 3/1954 | Snell | 252/136 |
| 3,709,824 | 1/1973 | Oda et al. | 252/136 |
| 4,014,804 | 3/1977 | Anderson | 252/136 |
| 4,561,993 | 12/1985 | Choy et al. | 252/174.25 |
| 4,678,541 | 7/1987 | Tytgat et al. | 134/3 X |
| 4,743,395 | 5/1988 | Leifheit | 252/545 |
| 5,078,896 | 1/1992 | Rorig et al. | 252/102 |

FOREIGN PATENT DOCUMENTS

| | | |
|---|---|---|
| 631065 | 11/1961 | Canada . |
| 816619 | 7/1959 | United Kingdom . |
| 1479591 | 7/1977 | United Kingdom . |

*Primary Examiner*—Stoll Robert L.
*Assistant Examiner*—Valene D. Fee
*Attorney, Agent, or Firm*—Frank A. Lukasik

[57] ABSTRACT

A chemical composition consisting of a very low pH mixture of hydrochloric and phosphoric acids with organic ammonium chlorides and organic sulfate. The composition is effective for the removal of rust and stains from a variety of surfaces, including metal, concrete, plastic, wood and fiberglass surfaces, and is non-corrosive to metals and relatively harmless to organic materials.

3 Claims, No Drawings

RUST AND STAIN REMOVAL COMPOSITION

FIELD OF THE INVENTION

The present invention relates to rust and stain removal and, particularly, to the removal of oxidized material and stains resulting therefrom from a variety of surfaces. More particularly, the invention relates to improved rust and stain removal compositions consisting essentially of very low pH mixtures of hydrochloric and phosphoric acids with organic ammonium chlorides and organic sulfate.

DESCRIPTION OF THE PRIOR ART

It is known that compositions comprising mixtures of acids may be employed to remove rust, corrosion and scale from metal surfaces and to function generally to accomplish chemical polishing and cleaning. For example, Martucci discloses in U.S. Pat. No. 4,675,120 that two strong acids, i.e., hydrochloric acid (HCl) and oxalic acid ($H_2C_2O_4$), may be mixed with two weak acids, i.e., phosphoric acid ($H_3PO_4$) and citric acid ($H_3C_6H_5O_7$), to provide a composition wherein a mechanism is established for controlling hydronium ion ($H_3O^+$) availability in the solution. According to Martucci, his composition is characterized by non-corrosive and non-toxic properties and, in particular, will hot corrode the surfaces of metals, nor will it attack organic substances such as skin, cloth or rubber. Martucci points out that his composition, although exhibiting the beneficial characteristics of non-corrosiveness and non-toxicity, maintain a high level of acidizing potential, i.e., a low pH generally on the order of less than 1, and thus is suitable for conventional acidizing functions, e.g., removal of oxides from metallic surfaces. Martucci also teaches that the ability to control hydronium ion availability in his solution can be enhanced in a variety of ways depending upon the particular application. For example, the effective removal of magnesium and calcium from boilers and heat exchangers can be achieved by adding a salt of oxalic acid to the solution; the effective removal of grease, oil and alkaline films, sediment, calcareous matter or organic matter from glass can be achieved by the addition of hydrofluoric acid (HF); the addition of sulphuric acid ($H_2SO_4$) can provide an additive for battery acids or a battery acid replacement; the addition of further amounts of hydrochloric acid, phosphoric acid, hydrofluoric acid and sulphuric acid together with glycerin can provide a material suitable for use in removing heavy corrosion from metal surfaces; the addition of urotropine can provide a solution suitable for application in the tertiary recovery of crude oil and gas from geological formations; and the addition of oleic acid and kerosene can provide a solution for application in the recovery of oil from oil-containing tar sands and treatment of heavy and ultra-heavy crudes.

In U.S. Pat. No. 5,108,544, Hakansson teaches a method for pickling iron and steel surfaces in which the surfaces are treated with a pickling bath which contains inhibitors, mineral acids and metal salts of the anions of the acids. The inhibitors are a mixture of tensides, silicates, phosphates and possibly oils, and the surfaces are preferably coated with inhibitor prior to being treated in the pickling bath. Examples of acids which can be used are sulphuric acid, nitric acid ($HNO_3$), hydrofluoric acid, hydrochloric acid and mixtures thereof. The process as a whole is based on the principle of pre-coating the surfaces with an inhibitor which functions to effectively block the bath acid from attacking the free iron. Hakansson teaches that surfaces to be pickled may be first subjected to a cleaning and biodegradation process either separately at pH values of 7 to 14 or in the same bath preferably at a pH value between 9.0 and 9.5.

Tytgat and Lefevre in U.S. Pat. No. 4,678,541 discloses baths for chemical polishing of stainless steel surfaces which comprise aqueous solutions of a mixture of hydrochloric acid, phosphoric acid and nitric acid, ferricyanide complex ions and an additive capable of decomposing nitrous acid ($HNO_2$). Examples given of the latter additive include sulphamic acid, hydroxylamine, hydrazine, hydrogen peroxide, acetone, urea and primary, secondary and tertiary amines. Nitrogen-containing compounds are identified as a class of substances which are especially advantageous as a bath additive, examples being urea and its derivatives, especially thiourea and alkyl ureas. The ranges of amounts of ingredients disclosed by Tytgat and Lefevre for their polishing baths are broadly 0.5 to 10 moles of HCl per liter, 0.01 to 2.5 moles of $H_3PO_4$ per liter, 0.001 to 1.5 moles of $HNO_3$ per liter, $0.3\times10^{-6}$ to $0.3\times10^{-2}$ gram-ions of ferricyanide per liter and a quantity of additive dependent upon the area of the metal to be polished, the volume of the bath employed, the mean depth of attack by the bath on the metal surface to be polished and a proportionality factor between $10^{-8}$ and $10^{-2}$.

It is clear from a review of the prior art that chemical removal of rust and stains and other corrosive products by the application of a comprising a mixture of acids has to date necessitated consideration of the particular application, such as the substrate to be contacted. This lack of universality, i.e., the ability of a given composition to act effectively on a variety of substrates or underlying surfaces, is of economic significance in that a variety of compositions must be maintained in order to treat the various applications that may be required. The maintenance of an inventory of compositions leads to the probability of erroneously using the wrong composition for a particular application, thus compounding the economic problem.

OBJECTS OF THE INVENTION

Accordingly, a principal object of the present invention is to provide an improved composition for the removal of oxidized material and stains resulting therefrom from a variety of surfaces.

Another object of the invention is to provide an improved rust and stain removal composition consisting essentially of very low pH mixtures of acids with ammonium chloride's and sulphate.

A further object of the invention is to provide a composition characterized by improved ability to remove oxidized material and stains resulting therefrom from a variety of substrates and which is non-corrosive to metals and relatively harmless to organic materials.

Other objects and advantages of the invention will be apparent to those skilled in the art upon reference to the following detailed description and specific examples.

SUMMARY OF THE INVENTION

The present invention relates to compositions consisting essentially of an aqueous solution of hydrochloric acid, phosphoric acid, ammonium chlorides and sulphate, said compositions being useful for the removal of oxidized material, such as rust, and stains resulting therefrom from a variety of surfaces, including metals, such as iron, steel, aluminum and chrome, painted surfaces, such as metal and wood, plastics, treated concrete surfaces, enameled surfaces and fiberglass. The usefulness of the inventive compositions is enhanced by their non-corrosive character with respect to substrates such as metal and their relatively harmless effect on organic materials.

Optimally, the inventive composition is essentially an aqueous solution of the following compounds in percent by weight:

| | |
|---|---|
| Hydrochloric acid | 15.0 |
| Phosphoric acid | 10.0 |
| Alkyl (50% $C_{14}$, 40% $C_{12}$, 10% $C_{16}$) dimethyl benzyl ammonium chloride | 0.08 |
| Dimethylethyl benzyl ammonium chloride | 0.10 |
| Octyl decyl dimethyl ammonium chloride | 0.05 |
| Dioctyl dimethyl ammonium chloride | 0.08 |
| Didecyl dimethyl ammonium chloride | 0.08 |
| Triethanolamine lauryl sulphate | 0.28 |

While the efficacy of such composition for its intended purpose may alter significantly if the stated percentages are departed from, nevertheless, a deviation up to 5 percent of the stated percentage of each compound may be tolerated without significantly departing from the advantageous characteristics of the invention. For example, in the case of hydrochloric acid, a 5 percent deviation contemplates a range of 14.25 to 15.75 percent. Similarly, a 5 percent deviation in the case of triethanolamine lauryl sulphate contemplates a range of 0.266 to 0.294 percent. From a preferential standpoint, however, it is desirable that any departure from the stated percentages of the optimum composition be limited to 3 percent of the stated percentage of each compound.

DETAILED DESCRIPTION AND SPECIFIC EMBODIMENTS

Example 1

A compositon was prepared consisting essentially of an aqueous solution of the following compounds in terms of percent by weight:

| | |
|---|---|
| Hydrochloric acid | 10.0 |
| Phosphoric acid | 7.0 |
| Dimethyl benzyl ammonium chloride | 0.03 |
| Dimethylethyl benzyl ammonium chloride | 0.07 |
| Didecyl dimethyl ammonium chloride | 0.02 |
| Octyl decyl dimethyl ammonium chloride | 0.05 |

The composition was tested by applying a small amount of the prepared solution to a rust-stain on a fiberglass surface. After a few minutes, it was noted that the stain still remained. A sponge was then wet with the solution and used to rub the stained area. The rubbing failed to clean the fiberglass surface and sub-surface staining was very much apparent. The solution was then allowed to "soak" the stained area for approximately 5 minutes. Following the soaking period, the stained area was again rubbed with a sponge and then rinsed with clear water. While the sponge was observed to have some rust stain on it, the fiberglass surface remained stained and showed no appreciable change.

Example 2

The Example 1 composition was then tested on a rust-stained, lacquer painted metal surface. The stain was created by allowing a steel bolt to rest upon the lacquer painted metal surface and deposit a stain as the bolt rusted. The stain was then allowed to "set" prior to testing. A small quantity of the solution (one-quarter ounce) was applied to the rust-stained area and allowed to soak for 5 minutes. Following the soaking period, the stained area was gently rubbed with a clean sponge and rinsed with water. There was some rust staining observed on the sponge and while the stained area appeared to be somewhat diminished, it was still quite apparent. At the same time, it was noted that the solution had no deleterious effect upon the lacquered surface.

Example 3

The Example 1 composition was next tested on a rust-stained ceramic tile surface. The surface was porous and had rust stains which were "set." A small quantity (one-half ounce) of the solution was applied to the rust-stained area and permitted to soak for 3 minutes. The surface was then rinsed with water. Upon close scrutiny, it was observed that all of the rust stain appeared to be gone and there was no apparent harm to the ceramic tile.

Example 4

The Example 1 composition was then tested on a rust-stained linoleum tile. A minute amount of the solution (one-sixteenth ounce) was applied directly to the stained area and immediately rinsed with water and wiped with a clean sponge. All of the stain on the linoleum tile was observed to be gone with no harm to the tile when observed under a 40 power microscope.

Example 5

The Example 1 composition was then tested on mildly oxidized, unpainted steel in the form of "drill bits." The degree of oxidation was such that the rust could not be removed using ordinary scouring methods. The drill bits were placed in a plastic container with approximately one ounce of solution and left to soak for 5 minutes. The solution, which was blue in color prior to the immersion of the drill bits, turned to a light green color. While the change in color is indicative of a degree of dissolution of the rust, notwithstanding, the net result was unsatisfactory since rust was still apparent on the drill bits.

Example 6

A composition was prepared consisting essentially of an aqueous solution of the following compounds in terms of percent by weight:

| | |
|---|---|
| Hydrochloric acid | 15.0 |
| Phosphoric acid | 10.0 |
| Alkyl (50% $C_{14}$, 40% $C_{12}$, 10% $C_{16}$) dimethyl benzyl ammonium chloride | 0.08 |
| Dimethylethyl benzyl ammonium chloride | 0.10 |
| Octyl decyl dimethyl ammonium chloride | 0.05 |
| Dioctyl dimethyl ammonium chloride | 0.08 |
| Didecyl dimethyl ammonium chloride | 0.08 |
| Triethanolamine lauryl sulphate | 0.28 |

The solution was tested by applying same to a rust stain which was located in the surface of a concrete driveway. Within 20 seconds the rust stain begin to dissolve rapidly. After rinsing with water and brushing lightly with a soft brush, it was observed that the rust stain was completely removed. The concrete surface and subsurface, i.e., pits and crannies, showed no sign of deterioration. Examination with a 40 power scope confirmed this observation.

Example 7

The composition of Example 6 was next tested on a section of fiberglass having a gel-coat finish that was penetrated by a rust stain. The rust stain covered an area approximately 3 inches by 5 inches and exhibited a dark rusty color, indicating that the rust had been soaking into the gel-coat for a prolonged period of time. Several drops of the solution were applied to the rust stain and the area was brushed lightly with a soft brush. A reaction was apparent from the discoloration of the solution on the surface of the fiberglass. The color of the solution turned from its original bluish tint to greenish yellow. The wet surface was then finger rubbed and rinsed with water. The surface appeared to be quite clean and there was no sign of the rust stain. This observation was confirmed by examination with a 40 power scope as was the fact that the gel-coat showed no sign of deterioration.

Example 8

The Example 6 composition was then tested on a rusted area of the surface of chromed stainless steel. A small amount of the solution was applied to the steel and then quickly fingerspread over the rusted area. After approximately 15 seconds, the surface was rinsed with water. All signs of the stain were observed to have been removed. It should be noted that the original stain had not penetrated beyond the chrome layer and that removal of the stain with the inventive composition left the chrome surface unharmed and relatively smooth to the touch. Confirmation was made with a 40 power scope. Previous attempts to remove similar stains from chromed stainless steel using conventional techniques resulted in a marring of the surface.

Example 9

A rusted garden tractor was selected for this test. The section to be tested involved a surface of primed, painted steel wherein layers of rust had risen to the surface from beneath the paint and primer. It appeared that moisture had gotten under the painted surface through numerous chips in the paint. A small amount (one-eighth ounce) of the solution of the Example 6 composition was applied to the stained section. The effect was almost immediate (5 seconds). The coloration of the wet surface changed from bluish to a bright greenish yellow and the rust stain was removed without any rubbing. The surface was then rinsed with water and stain removal was confirmed with a 40 power scope. The only surface deterioration observed was the preexisting chips in the paint.

Example 10

A rust-stained painted wood surface was selected for this test. The stain was developed from rusty iron bolts that penetrated the wood surface. A small amount of the solution of the Example 6 composition was sprayed on the stained area. The stain was removed in less than 2 seconds. After rinsing with water, it was noted not only that the stain was completely gone, but the surface was so clean that it appeared to have been repainted.

Example 11

The inventive composition of Example 6 was next tested on an oxidized section of an aluminum boat. The aluminum surface had oxidized as a result of exposure to the salt water of the sea. A small amount of the inventive solution was applied to the oxidized area and rinsed with clear water after 5 seconds. The aluminum surface appeared free and clear of oxidation without any signs of harmful effect from the treatment. This was confirmed upon examination with a 40 power scope.

Example 12

The Example 6 composition was then tested on a cloth fabric (50% polyester 50% cotton). The portion tested had a rust stain that had completely penetrated the fabric. A small amount of the inventive solution was applied directly to the rust-stained area and rubbed lightly. The penetration of the fabric by the solution was rapid and the stain was removed in 3 seconds. The fabric was then rinsed in cold water and examined with a 40 power scope. No apparent deterioration of the fabric was observed. While some "yellow" was observed with the scope, it could not be detected with the naked eye.

Example 13

Some rusty drill bits were selected for this test. Several layers of rust had accumulated in the bits over an extended period of time. In this test the bits were immersed in a one-half ounce "bath" of the solution of the Example 6 composition. Upon immersion, the bits were "rolled" through the bath using one's fingers. No scrubbing was involved, yet the bits appeared to be cleansed of the rust in a mere one minute's time. The bits were then rinsed with water and examined under a 40 power scope. Some deterioration of the bits was detected but this was attributable to the original layers of oxidation and not the result of treatment with the inventive composition. The cleaned bits were then placed in a drill and performed satisfactorily.

Although the present invention has been described and illustrated in detail, it is understood that the same is by way of illustration and example only and is not to be taken by way of limitation, the spirit and scope of the present invention being limited only by the terms of the appended claims.

What is claimed is:

1. A composition consisting essentially of an aqueous solution of the following compounds, each of said components ranging within 5 percent of the stated amounts in terms of percent by weight:

| | |
|---|---|
| Hydrochloric acid | 15.0 |
| Phosphoric acid | 10.0 |
| Alkyl (50% $C_{14}$, 40% $C_{12}$, 10% $C_{16}$) dimethyl benzyl ammonium chloride | 0.08 |
| Dimethylethyl benzyl ammonium chloride | 0.10 |
| Octyl decyl dimethyl ammonium chloride | 0.05 |
| Dioctyl dimethyl ammonium chloride | 0.08 |
| Didecyl dimethyl ammonium chloride | 0.08 |
| Triethanolamine lauryl sulphate | 0.28 |
| Water | Balance |

said composition being useful for the removal of rust and stains resulting from the oxidation of metal.

2. A composition according to claim 1 wherein each of said compounds ranges within 3 percent of the stated amounts in terms of percent by weight.

3. A composition according to claim 1 wherein each of said compounds is present in the stated amounts in terms of percent by weight.

* * * * *